US009702126B1

(12) United States Patent
Feher

(10) Patent No.: US 9,702,126 B1
(45) Date of Patent: Jul. 11, 2017

(54) FAUCET STEPPED LEGS AND ASSEMBLY METHOD

(71) Applicant: Timothy A. Feher, Belle Vernon, PA (US)

(72) Inventor: Timothy A. Feher, Belle Vernon, PA (US)

( * ) Notice: Subject to any disclaimer, the term of this patent is extended or adjusted under 35 U.S.C. 154(b) by 0 days.

(21) Appl. No.: 14/971,558

(22) Filed: Dec. 16, 2015

Related U.S. Application Data

(60) Provisional application No. 62/128,019, filed on Mar. 4, 2015.

(51) Int. Cl.
*E03C 1/04* (2006.01)

(52) U.S. Cl.
CPC ..... *E03C 1/0404* (2013.01); *E03C 1/0402* (2013.01)

(58) Field of Classification Search
CPC ..... E03C 1/0404; E03C 1/0402
See application file for complete search history.

(56) References Cited

U.S. PATENT DOCUMENTS

| | | | | |
|---|---|---|---|---|
| 5,946,746 | A * | 9/1999 | Bloom | E03C 1/0401 137/801 |
| 6,421,849 | B1 * | 7/2002 | Gray | E03C 1/0401 137/360 |
| 9,133,607 | B2 * | 9/2015 | Schoolcraft | E03C 1/057 |
| 2006/0124183 | A1 * | 6/2006 | Kuo | E03C 1/0401 137/801 |
| 2007/0031624 | A1 * | 2/2007 | Brosius | F16L 9/147 428/36.91 |
| 2013/0199623 | A1 * | 8/2013 | Lloyd | E03C 1/0401 137/15.01 |

* cited by examiner

*Primary Examiner* — Janie Loeppke
(74) *Attorney, Agent, or Firm* — Nils H. Ljungman & Associates

(57) ABSTRACT

A faucet stepped legs and assembly method. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

19 Claims, 4 Drawing Sheets

FAUCET STEPPED LEGS AND ASSEMBLY METHOD

BACKGROUND

1. Technical Field

The present application relates to faucet stepped legs and assembly method.

2. Background Information

Background information is for informational purposes only and does not necessarily admit that subsequently mentioned information and publications are prior art.

The present application relates to the plumbing field and generally to water faucets.

Faucets are generally installed to a sink deck where the supply lines are connected to hot or cold water valves that are located beneath the sink. This operation can be awkward working under the sink. There can be obstructions like the drains in the way, along with being a tight and dark area. An installer usually has to lie on his back looking awkwardly at the connections to the faucet. In addition, the installer may have drippings, dirt accumulated during years of use and other debris which may fall on him and make the working environment very unpleasant. This makes it a harder challenge while using tools to connect the supply lines properly.

OBJECT OR OBJECTS

An object of the present application may be to provide a faucet design in which the legs are stepped and permit an installer to work in a more pleasant and easier space.

SUMMARY

The faucet design can be of any design known to the art, such as those with a single faucet spout with a single handle or two handles where hot and cold water travels through the legs. The unique feature of the design is that the legs that the fluid travels through are stepped to permit easier assembly and installation of the plumbing related to the faucet.

The stepped legs may have two or more steps which are or are not threaded. The legs can be made out of any material suitable for the plumbing field as copper, brass, plastic, etc. Securing the faucet is done by threading nuts to the larger portion of the stepped legs. The bottom smaller portion of the stepped legs is threaded to accept a supply line or smooth to accept a quick connect fitting. Thereby providing hot and cold water to the faucet assembly.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

DESCRIPTION OF EMBODIMENT OR EMBODIMENT

Figure 1:
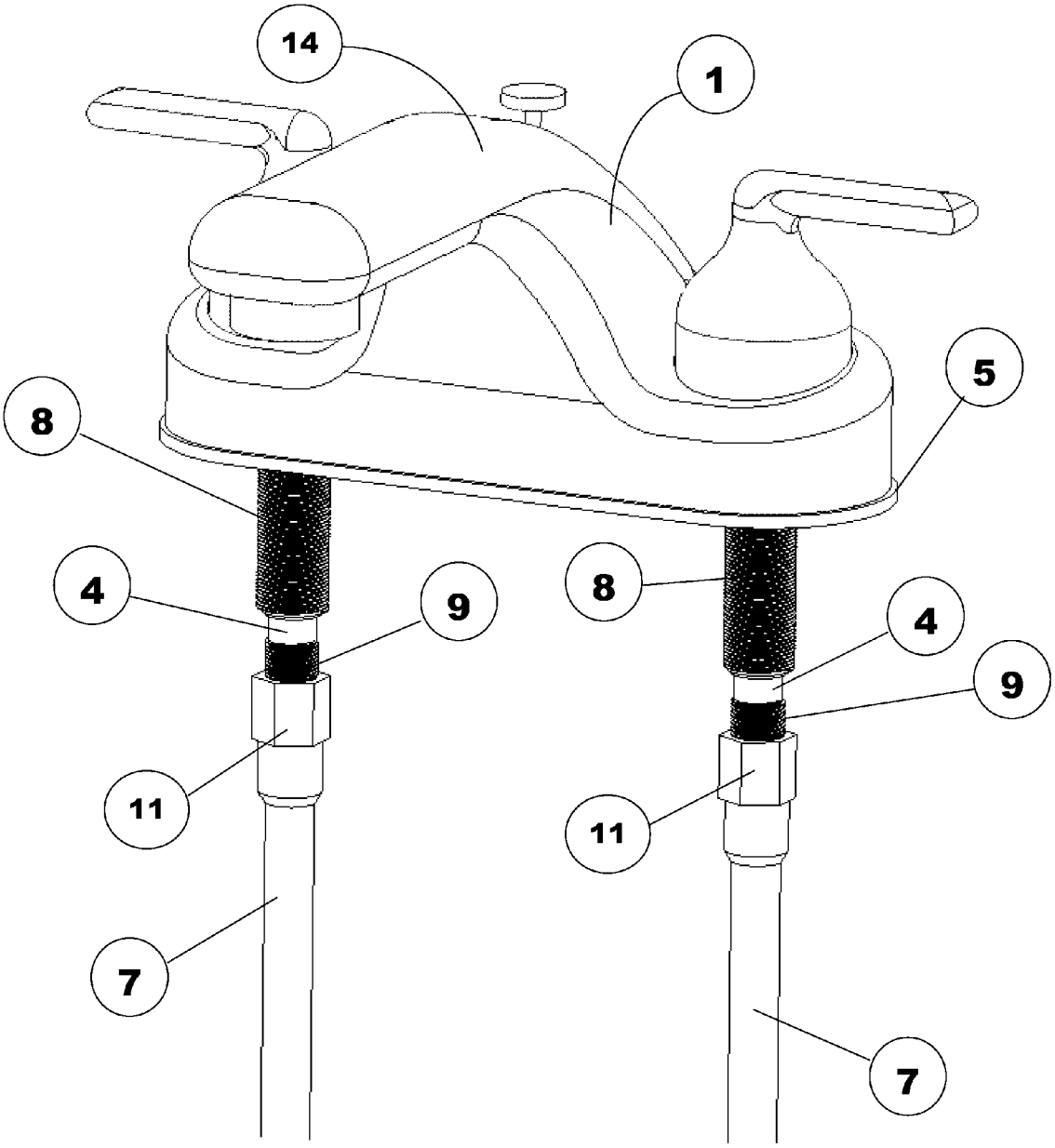
FIG. 1 is a view of a faucet showing the stepped legs with supply lines attached.

Starting with FIG. 1, the faucet 1 shows the supply line 7 connected to the stepped leg 4. The supply line connection 11 is attached to the leg 4 which is threaded with a smaller diameter 9, which is smaller than the leg threaded larger diameter 8. The supply line 7 is attached to the smaller diameter 9 using a wrench. FIG. 4 shows an alternative connection if a quick connect fitting is used. This area 9 usually has Teflon tape applied to the threads prior to connection to eliminate or minimize leakage. Between the faucet 1 and the sink, a gasket 5 is placed to prevent or at least minimize water from leaking under the faucet 1 into the area under the sink. The nut 11 holds the supply line 7 to the faucet assembly 1 by being threaded onto the smaller diameter leg 9. The larger diameter portion of the stepped leg 4 will receive a securing nut 6 as shown in FIG. 3.

The present assembly methods makes this assembly prior to installation and would have this operation being done after the fixture is assembled for installation to the sink deck.

Figure 2:
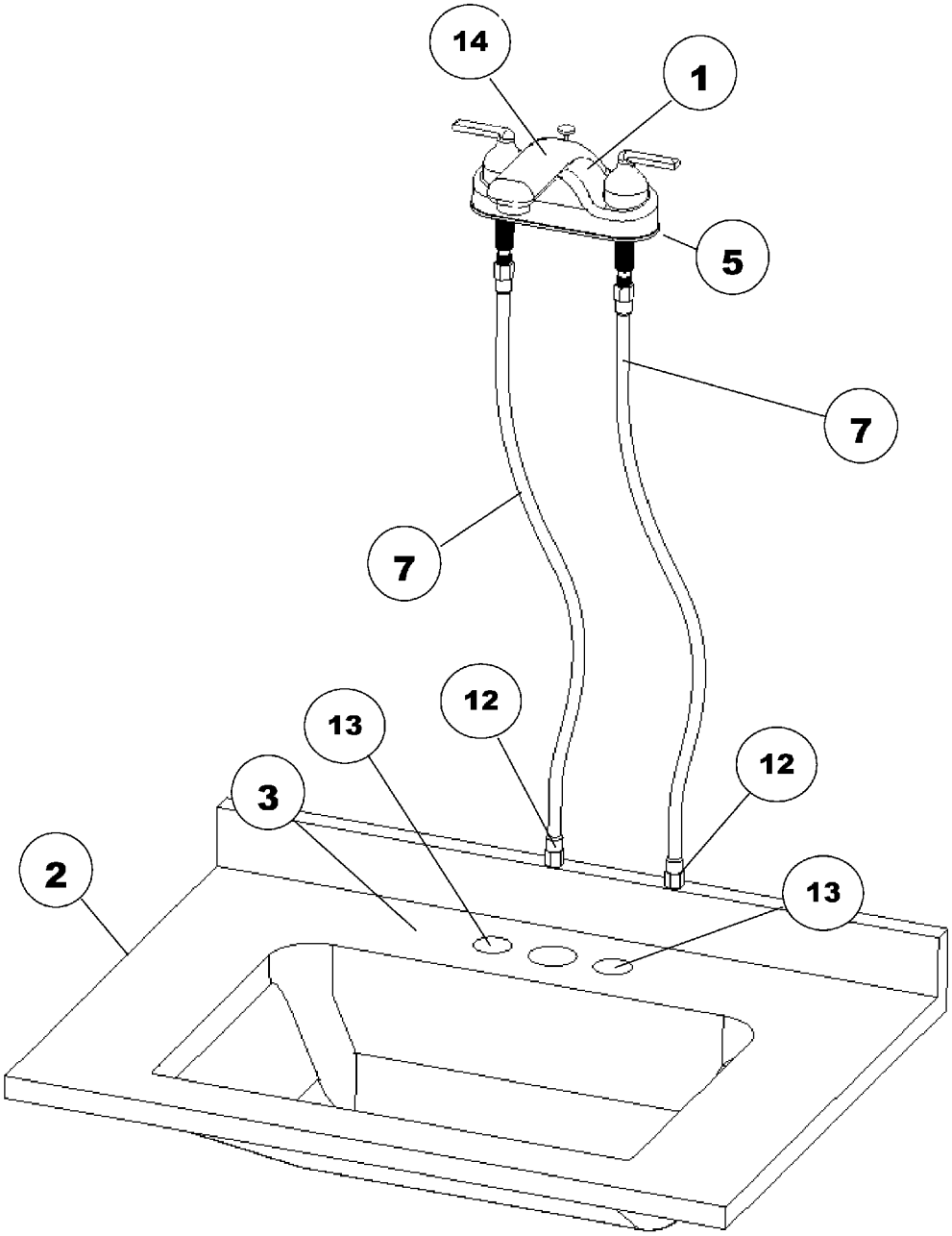
FIG. 2 is a view of the supply lines connected to the faucets stepped legs prior to being assembled to the sink deck.

In FIG. 2, insert the supply line 7 through the gasket 5 and then placing the faucet 1, gasket 5 and supply line 7 assembly 14 through the sink access holes 13 on the sink deck 3. It would be recommended to use the appropriate plumbers putty or caulking between the gasket 5 and sink deck 3.

Figure 3:
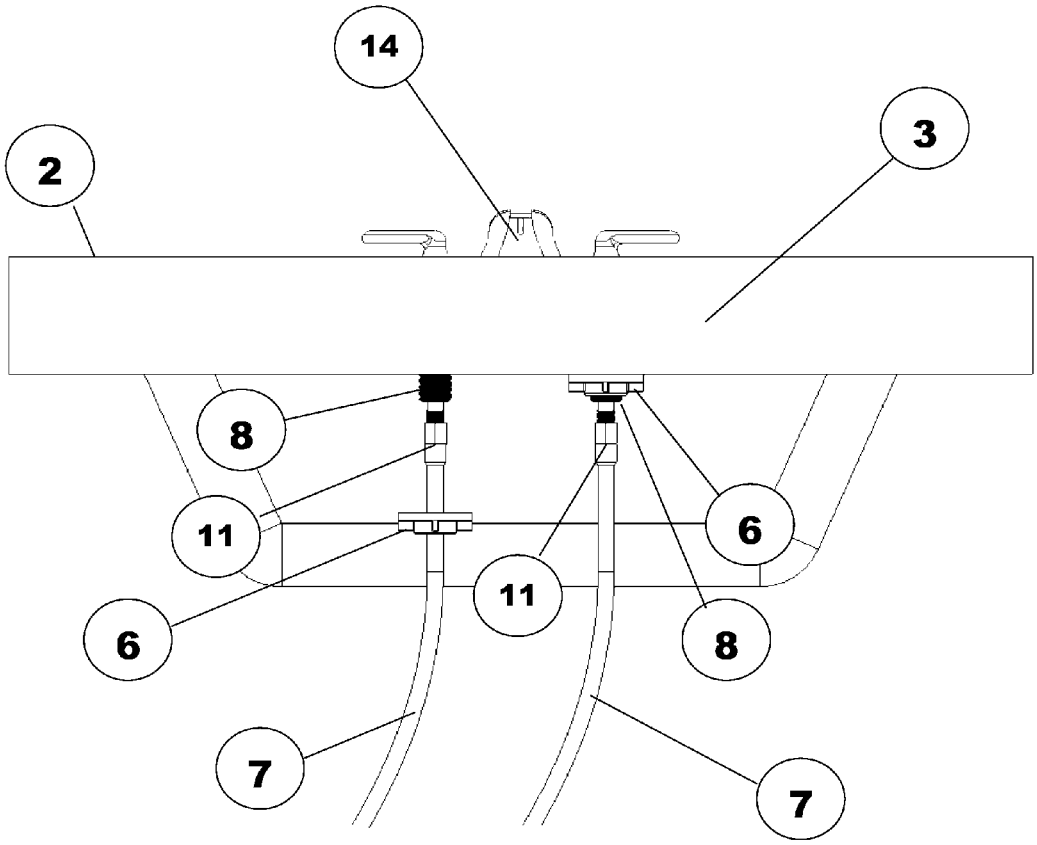
FIG. 3 is a view of the back of the sink with the faucet assembled to the sink deck.
Figure 4:
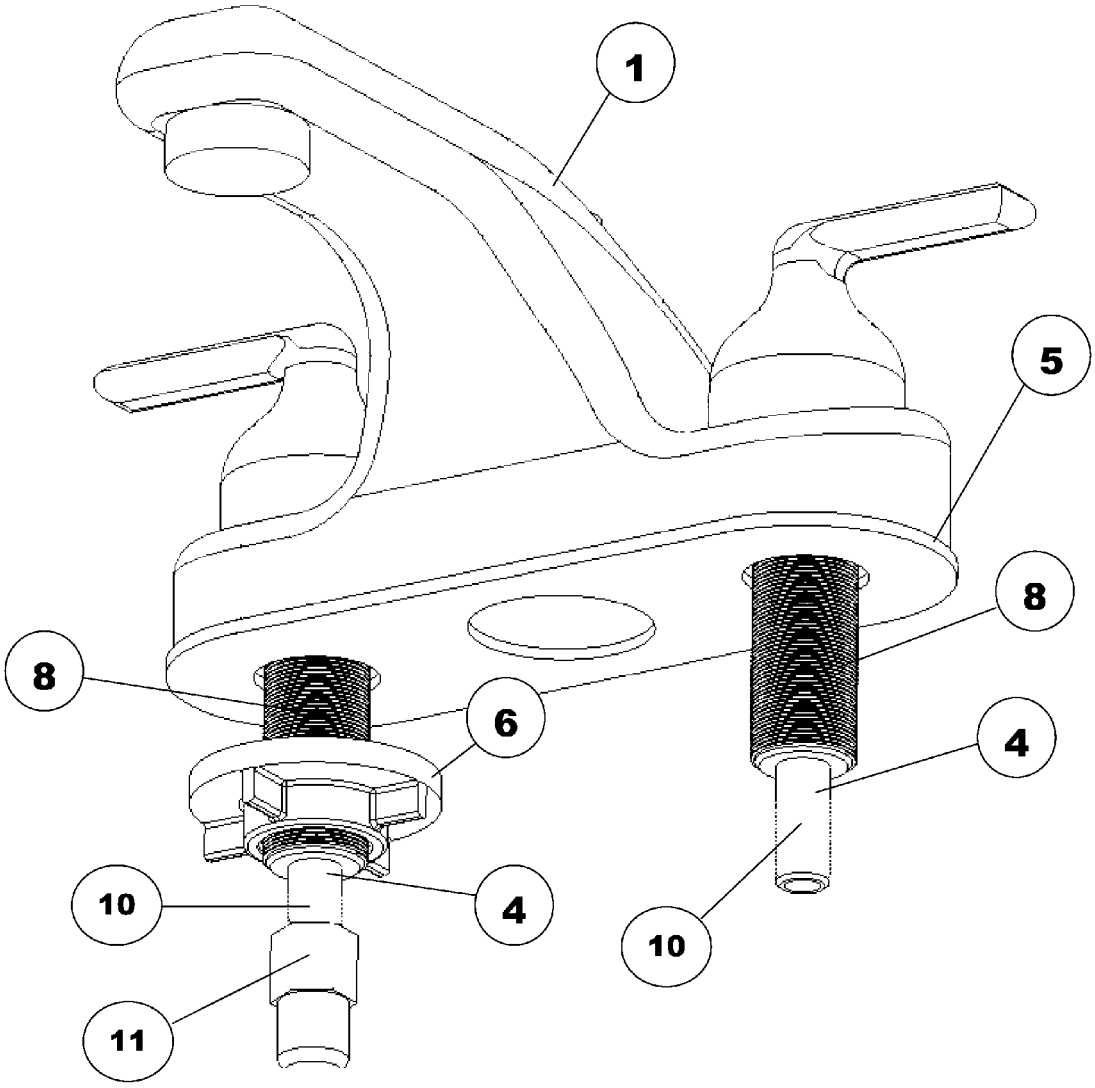
FIG. 4 a view of the faucet with the quick connect fitting portion of the stepped legs.

FIG. 3 shows assembly 14 with the supply lines 7 attached above the sink 2. The faucet assembly 14 is to be located on the sink deck 3. The securing nuts 6 are assembled over the supply line 7 and then over the supply line connection 11, until engaging the leg threaded larger diameter 8. The securing nuts 6, as shown in FIG. 3, are threaded on the larger diameter leg until the assembly 14 is firmly attached to the sink deck 3. This step can be done using installer's hands with no tool required, along with having installer positioned outside the sink instead of under the sink.

The present assembly method has the supply lines attached to water supplies after the faucet is secured to the sink deck. The installation of the faucet assembly 14 would in most instances not require as taught herein reaching up while the installer is in a tight, dark area with obstructions to apply Teflon tape to the legs. Finally the supply lines would be connected to the legs 7 using a wrench or a basin wrench. In the prior art, in some cases one would have to use both hands while lying on the back.

After the assembly 14 is secured to the sink 2 with the securing nuts 6, the final assembly step would be to attach the valve supply line connection 12 of the supply line 7 to the hot and cold water valves, and then turn on the hot and cold water valves to test the faucet installation.

This disassembly follows similar disassemblies known to the art with the normal process being simplified.

Start by turning off the hot and cold water valve supply. Disconnect the supply line 7 valve supply connection 12 from the supply valves. Remove securing nuts 6 from stepped legs 4. This can usually be done with one hand without be positioned under the sink on your back.

The present disassembly method would be after the valve supply connection step is completed. Disconnect the supply lines from the legs. This is done by using a wrench or basin wrench while using both hands and positioning yourself under the sink on your back. This can be awkward trying to work around obstacles while reaching upward to loosen the connection in a tight, dark area. After the supply lines are disconnected, the securing nuts can be unthreaded and the faucet can be removed.

Slide the securing nuts 6 over the supply line connection 11 and off the supply line 7. Remove assembly 14 FIG. 2.

A faucet of any design known to the art where hot and cold fluid or only one kind of fluid travels through a single valve to a spigot travels through the leg or legs. A description to simplify a faucet assembly and disassembly method to a sink base.

The components disclosed in the patents, patent applications, patent publications, and other documents disclosed or incorporated by reference herein, may possibly be used in possible embodiments of the present invention, as well as equivalents thereof.

One feature or aspect of an embodiment is believed at the time of the filing of this patent application to possibly reside broadly in a method of installing a faucet on a sink, said method comprising: a threaded leg comprising a first portion being threaded and connected to the body of said faucet; a passage in said first portion fluidly being connected directly to a valve in said faucet; said faucet being configured to pass liquid from a supply line to said valve in said faucet; and a second portion configured to be disposed between said supply line of said first portion; said first threaded portion having a substantially larger outer diameter than the outer diameter of said second portion; attaching a supply line to said second portion; running said supply line down into and through a sink access hole in said sink; disposing a securing nut onto said supply line after said supply line has been extended to an area under a sink deck; said securing nut having a threaded diameter configured to pass over said second portion and thread onto said first threaded portion; pushing said nut over said supply line and said second portion while positioning oneself outside a portion of said sink deck while threading said nut onto said first portion; and tightening said nut and securing said faucet to said sink deck.

One feature or aspect of an embodiment is believed at the time of the filing of this patent application to possibly reside broadly in a method of installing a faucet on a sink, wherein said faucet comprises: a faucet body with two fluid supply arrangements expending from said faucet body; each said fluid supply arrangement comprising a cylindrical body with a fluid supply passage therein; said fluid supply passage being connected or connectable to a valve to supply fluid to said valve; said faucet body comprising said first portion being threaded and connected to said faucet body; said faucet body comprising each second portion configured to be disposed or being disposed between said supply line of said first portion; said first threaded portion comprising a substantially larger outer diameter than the outer diameter of said second portion; said method comprising: attaching a fluid supply line to each fluid supply arrangement; running each said supply line down into and through its sink access hole in said sink; disposing a securing nut onto each said supply line after each said supply line has been extended to an area under a sink deck; each said securing nut having a threaded diameter configured to pass over each said second portion and a connector attached to each said second portion; threading each said securing nut onto said first portion; an installer pushing each said nut over its said supply line and its said second portion while positioning him- or herself outside a portion of said sink deck while threading each said nut onto its first portion; and tightening each said nut and securing said faucet to said sink deck.

One feature or aspect of an embodiment is believed at the time of the filing of this patent application to possibly reside broadly in a method of installing a faucet on a sink, wherein said faucet comprises: a faucet body comprising a spout and at least one fluid control handle; said faucet body comprising two fluid supply arrangements extending from said faucet body; each said fluid supply arrangement comprising a cylindrical body with a fluid supply passage therein; each said fluid supply passage being connected or connectable to a valve to supply fluid to said valve; said faucet body comprising said first portion being connected to said faucet body; said first portion being threaded to receive a securing nut; said faucet body comprising each second portion configured to be disposed or being disposed between said supply line of said first portion; each second portion configured to be connectable to a connecting element configured to connect said supply line to a supply line; said first portion comprising a substantially larger outer diameter than the outer diameter of said second portion; the outer diameter of said second portion being sufficiently small to permit said securing nut to pass therethrough; said method comprising: attaching a fluid supply line to each fluid supply arrangement; running each said supply line down into and through its sink access hole in said sink; disposing each said securing nut onto each said supply line after each said supply line has been extended to an area under a sink deck; each said securing nut having a threaded inside diameter configured to pass over each said second portion and a connector attached to each said second portion; an installer pushing each said nut over its said supply line and its said second portion while positioning him- or herself outside a portion of said sink deck while threading each said nut onto its first portion; threading each said securing nut onto said first portion; and tightening each said securing nut and securing said faucet to said sink deck.

One feature or aspect of an embodiment is believed at the time of the filing of this patent application to possibly reside broadly in a method of installing a faucet on a sink, by hand, without the installer having to on his or her back under the sink, wherein said faucet comprises: a faucet body comprising a spout and at least one fluid control handle; said faucet body comprising two fluid supply arrangements extending from said faucet body; each said fluid supply arrangement comprising a cylindrical body with a fluid supply passage therein; each said fluid supply passage being connected or connectable to a valve to supply fluid to said valve; said faucet body comprising said first portion being connected to said faucet body; said first portion being threaded to receive a securing nut; said faucet body comprising each second portion configured to be disposed or being disposed between said supply line of said first portion; each second portion configured to be connectable to a connecting element configured to connect said supply line to a supply line; said first portion comprising a substantially larger outer diameter than the outer diameter of said second portion; the outer diameter of said second portion being sufficiently small to permit said securing nut to pass thereover; each said securing nut comprising a thread configured to mate with its thread of its first portion; said method comprising: attaching a fluid supply line to each fluid supply arrangement; running each said supply line down into and through its sink access hole in said sink; disposing each said securing nut, by hand, onto each said supply line after each said supply line has been extended to an area under a sink deck; each said securing nut having a threaded inside diameter configured to pass over each said second portion and a connector attached to each said second portion; an installer pushing each said nut, by hand, over its said supply line and its said second portion while positioning him- or herself outside a portion of said sink deck while threading each said nut onto its first portion; threading, by hand, each said securing nut onto said first portion; and tightening each said securing nut, by hand, and securing said faucet to said sink deck.

One feature or aspect of an embodiment is believed at the time of the filing of this patent application to possibly reside broadly in a method of installing a hot and cold water faucet on a sink, by hand, without the installer having to be on his or her back under the sink, wherein said faucet comprises: a faucet body comprising a spout and at least one water control handle; said faucet body comprising two water supply arrangements extending from said faucet body; each said fluid supply arrangement comprising a body with at least two parts cylindrical and with a fluid supply passage therein; each said fluid supply passage being connected or connectable to a valve to supply fluid to said valve; each said first portion being connected to said faucet body; said first portion comprising a threaded portion configured to receive a securing nut; each second portion configured to be disposed or being disposed between said supply line of said first portion; each second portion configured to be connectable to a connecting element configured to connect said supply line to a supply line; said first portion comprising a substantially larger outer diameter than the outer diameter of said second portion; the outer diameter of said second portion being sufficiently small to permit said securing nut to pass thereover; each said securing nut comprising a thread configured to mate with the thread of its corresponding first portion; said method comprising: attaching a fluid supply line to each fluid supply arrangement; running each said supply line down into and through its sink access hole in said sink; disposing each said securing nut, by hand, onto each said supply line after each said supply line has been extended to an area under a sink deck; each said securing nut having a threaded inside diameter configured to pass over each said second portion and a connector attached to each said second portion; an installer pushing each said nut, by hand, over its said supply line and its said second portion while positioning him- or herself with his or her body outside a portion of said sink deck while manipulating each said nut onto its first portion; threading, by hand, each said securing nut onto said first portion while positioning him- or herself with his or her body outside a portion of said sink deck; and tightening each said securing nut, by hand, and securing said faucet to said sink deck while positioning him- or herself with his or her body outside a portion of said sink deck.

One feature or aspect of an embodiment is believed at the time of the filing of this patent application to possibly reside broadly in a method of installing a hot and cold water faucet on a sink, by hand, without the installer having to be on his or her back under the sink, wherein said faucet comprises: a faucet body comprising a spout and at least one water control handle; said faucet body comprising two water supply arrangements extending from said faucet body; each said water supply arrangement comprising a cylindrical body with at least two parts and with a water supply passage therein; each said water supply passage being connected or connectable to a valve to supply water to said valve; each said first portion being connected or connectable to said faucet body; said first portion comprising a threaded portion configured to receive a securing nut; each second portion configured to be disposed or being disposed between said supply line of said first portion; each second portion configured to be connectable to a connecting element configured to connect said supply line to a supply line; said first portion comprising a larger outer diameter than the outer diameter of said second portion; the outer diameter of said second portion being sufficiently small to permit said securing nut to pass thereover; each said securing nut comprising a thread configured to mate with the thread of its corresponding first portion; said method comprising: attaching a water supply line to each water supply arrangement; running each said supply line down into and through its sink access hole in said sink; disposing each said securing nut, by hand, onto each said supply line after each said supply line has been extended to an area under a sink deck; each said securing nut having a threaded inside diameter configured to pass over each said second portion and a connector attached to each said second portion; an installer pushing each said nut, by hand, over its said supply line and its said second portion while positioning him- or herself with his or her body outside a portion of said sink deck while without the installer having to be on his or her back under the sink and while manipulating each said nut onto its corresponding first portion; threading, by hand, each said securing nut onto said first portion while positioning him- or herself with his or her body outside a portion of said sink deck and without the installer having to be on his or her back under the sink; and tightening each said securing nut, by hand, and securing said faucet to said sink deck while positioning him- or herself with his or her body outside a portion of said sink deck and without the installer having to be on his or her back under the sink.

One feature or aspect of an embodiment is believed at the time of the filing of this patent application to possibly reside broadly in a method of installing a hot and cold water faucet on a sink, by hand, without the installer having to be on his or her back under the sink, wherein said faucet comprises: a faucet body comprising a spout and at least one water control handle; said faucet body comprising two water supply arrangements extending from said faucet body; each said water supply arrangement comprising a cylindrical body with at least two parts and with a water supply passage therein; each said water supply passage being connected or connectable to a valve to supply water to said valve; each said first portion being connected or connectable to said faucet body; said first portion comprising a threaded portion configured to receive a securing nut; each second portion configured to be disposed or being disposed between said supply line of said first portion; each second portion configured to be connectable to a connecting element configured to connect said supply line to a supply line; said first portion comprising a larger outer diameter than the outer diameter of said second portion; the outer diameter of said second portion being sufficiently small to permit said securing nut to pass thereover; each said securing nut comprising a thread configured to mate with the thread of its corresponding first portion; said method comprising: attaching a water supply line to each water supply arrangement; running each said supply line down into and through its sink access hole in said sink; disposing each said securing nut, by hand, onto each said supply line after each said supply line has been extended to an area under a sink deck; each said securing nut having a threaded inside diameter configured to pass over each said second portion and a connector attached to each said second portion; an installer pushing each said nut, by hand, over its corresponding supply line and its corresponding second portion while positioning him- or herself with his or her body outside a portion of said sink deck while without the installer having to be on his or her back under the sink and while manipulating each said nut onto its corresponding first portion; threading, by hand, each said securing nut onto said first portion while positioning him- or herself with his or her body outside a portion of said sink deck and without the installer having to be on his or her back under the sink; and tightening each said securing nut, by hand, and securing said faucet to said sink deck while positioning him- or herself with his or her body outside a portion of said sink deck and without the installer having to be on his or her back under the sink.

Another feature or aspect of an embodiment is believed at the time of the filing of this patent application to possibly reside broadly in the method of installing a hot and cold water faucet on a sink, by hand, without the installer having to be on his or her back under the sink wherein said attachment nuts being configured to be easily handled by an installer and having appendages configured to increase the torque available to an installer's hand.

Yet feature or aspect of an embodiment is believed at the time of the filing of this patent application to possibly reside broadly in the method of installing a hot and cold water faucet on a sink, by hand, without the installer having to be on his or her back under the sink wherein said appendages are radial and flat.

Still another feature or aspect of an embodiment is believed at the time of the filing of this patent application to possibly reside broadly in the method of installing a hot and cold water faucet on a sink, by hand, without the installer having to be on his or her back under the sink wherein said water supply arrangements each comprise a single part.

A further feature or aspect of an embodiment is believed at the time of the filing of this patent application to possibly reside broadly in the method of installing a hot and cold water faucet on a sink, by hand, without the installer having to be on his or her back under the sink wherein said water supply arrangements each are permanently connected to its corresponding valve.

Another feature or aspect of an embodiment is believed at the time of the filing of this patent application to possibly reside broadly in the method of installing a hot and cold water faucet on a sink, by hand, without the installer having to be on his or her back under the sink wherein said water supply arrangements each are disconnectable from its corresponding valve.

Yet another feature or aspect of an embodiment is believed at the time of the filing of this patent application to possibly reside broadly in the method of installing a hot and cold water faucet on a sink, by hand, without the installer having to be on his or her back under the sink wherein said first portion and said second portion are disconnectable from one another.

Still another feature or aspect of an embodiment is believed at the time of the filing of this patent application to possibly reside broadly in the method of installing a hot and cold water faucet on a sink, by hand, without the installer having to be on his or her back under the sink where each said second portion comprises: a threaded portion configured to receive said connecting element which is threaded or a quick connect portion configured to receive said connecting element which is a quick connect connecting element.

One feature or aspect of an embodiment is believed at the time of the filing of this patent application to possibly reside broadly in a hot and cold water faucet arrangement configured to be installed on a sink, by hand, without the installer having to be on his or her back under the sink, wherein said faucet comprises: a faucet body comprising a spout and at least one water control handle; said faucet body comprising two water supply arrangements extending from said faucet body; each said water supply arrangement comprising a cylindrical body with at least two parts and with a water supply passage therein; each said water supply passage being connected or connectable to a valve to supply water to said valve; each said first portion being connected or connectable to said faucet body; said first portion comprising a threaded portion configured to receive a securing nut; each second portion configured to be disposed or being disposed between said supply line of said first portion; each second portion configured to be connectable to a connecting element configured to connect said supply line to a supply line; said first portion comprising a larger outer diameter than the outer diameter of said second portion; the outer diameter of said second portion being sufficiently small to permit said securing nut to pass thereover; each said securing nut comprising a thread configured to mate with the thread of its corresponding first portion; each water supply line being configured to be attachable to each water supply arrangement; each said supply line being configured to be run down into and through its corresponding sink access hole in said sink; each said securing nut being configured to be disposed, by hand, onto each said supply line after each said supply line has been extended to an area under a sink deck; each said securing nut having a threaded inside diameter configured to pass over each said second portion and a connector attached to each said second portion; each said nut being installable, by hand, over its corresponding supply line and its corresponding second portion with an installer positioning him- or herself with his or her body outside a portion of said sink deck while without the installer having to be on his or her back under the sink and while manipulating each said nut onto its corresponding first portion; each said securing nut being threadable by hand onto said first portion upon an installer positioning him- or herself with his or her body outside a portion of said sink deck and without the installer having to be on his or her back under the sink; and each said securing nut being tightenable, by hand, to secure said faucet to said sink deck upon an installer positioning him- or herself with his or her body outside a portion of said sink deck and without the installer having to be on his or her back under the sink.

One feature or aspect of an embodiment is believed at the time of the filing of this patent application to possibly reside broadly in a hot and cold water faucet arrangement configured to be installed on a sink, by hand, without the installer having to be on his or her back under the sink, wherein said faucet comprises: a faucet body comprising a spout and at least one water control handle; said faucet body comprising two water supply arrangements extending from said faucet body; each said water supply arrangement comprising a cylindrical body with at least two parts and with a water supply passage therein; each said water supply passage being connected or connectable to a valve to supply water to said valve; each said first portion being connected or connectable to said faucet body; said first portion comprising a threaded portion configured to receive a securing nut; each second portion configured to be disposable or being disposed between said supply line of said first portion; each second portion configured to be connectable to a connecting element configured to connect said supply line to a supply line; said first portion comprising a larger outer diameter than the outer diameter of said second portion; the outer diameter of each said second portion and each said connecting element being sufficiently small to permit said securing nut to pass thereover; each said securing nut comprising a thread configured to mate with the thread of its corresponding first portion; each water supply line being configured to be attachable to each water supply arrangement; each said supply line being configured to be run down into and through its corresponding sink access hole in said sink; each said securing nut being configured to be disposed, by hand, onto each said supply line after each said supply line has been extended to an area under a sink deck; each said securing nut having a threaded inside diameter configured to pass over each said second portion and a connector attached to each said second portion; each said nut being installable, by hand, over its corresponding supply line and its corresponding second portion with an installer positioning him- or herself with his or her body outside a portion of said sink deck while without the installer having to be on his or her back under the sink and while manipulating each said nut onto its corresponding first portion; each said securing nut being threadable by hand onto said first portion upon an installer positioning him- or herself with his or her body outside a portion of said sink deck and without the installer having to be on his or her back under the sink; and each said securing nut being tightenable, by hand, to secure said faucet to said sink deck upon an installer positioning him- or herself with his or her body outside a portion of said sink deck and without the installer having to be on his or her back under the sink.

Another feature or aspect of an embodiment is believed at the time of the filing of this patent application to possibly reside broadly in the hot and cold water faucet arrangement configured to be installable on a sink, by hand, without the installer having to be on his or her back under the sink wherein one of the following: (A) said attachment nuts being configured to be easily handled by an installer and having appendages configured to increase the torque available to an installer's hand; (B) said water supply arrangements each comprise a single part; (C) said water supply arrangements each are permanently connected to its corresponding valve; (D) said water supply arrangements each are disconnectable from its corresponding valve; (E) said first portion and said second portion are disconnectable from one another; and (F) said attachment nuts being configured to be easily handled by an installer and having appendages configured to increase the torque available to an installer's hand; and said appendages comprising radial appendages with flat radial surfaces.

The following patents, patent applications, patent publications, and other patent documents are hereby incorporated herein as if set forth in their entirety herein, except for the exceptions indicated herein: U.S. Patent Application No. 2011/0061753; U.S. Pat. No. 8,931,500; U.S. Pat. No. 8,695,625; U.S. Pat. No. 8,439,076; U.S. Pat. No. 6,631,730; U.S. Pat. No. 5,865,211; U.S. Pat. No. 4,186,761; U.S. Pat. No. 3,790,966; and U.S. Pat. No. 2,591,991.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications, patent publications, and other documents cited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, patent applications, patent publications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, patent applications, patent publications, and other documents either incorporated by reference or not incorporated by reference.

All of the references and documents cited in any of the patents, patent applications, patent publications, and other documents cited herein, except for the exceptions indicated herein, are hereby incorporated by reference as if set forth in their entirety herein except for the exceptions indicated herein. All of the patents, patent applications, patent publications, and other documents cited herein, referred to in the immediately preceding sentence, include all of the patents, patent applications, patent publications, and other documents cited anywhere in the present application.

Words relating to the opinions and judgments of the author of all patents, patent applications, patent publications, and other documents cited herein and not directly relating to the technical details of the description of the embodiments therein are not incorporated by reference.

The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments of the patents, patent applications, patent publications, and other documents, are not considered to be incorporated by reference herein for any of the patents, patent applications, patent publications, and other documents cited herein.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications, patent publications, and other documents cited herein may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

LIST OF AT LEAST PARTIAL NOMENCLATURE

1 FAUCET
2 SINK
3 SINK DECK
4 STEPPED LEG
5 GASKET
6 SECURING NUT
7 SUPPLY LINE
8 LEG THREADED LARGER DIAMETER
9 LEG THREADED SMALLER DIAMETER
10 LEG SMOOTH SMALLER DIAMETER
11 SUPPLY LINE CONNECTION
12 VALVE SUPPLY LINE CONNECTION
13 SINK ACCESS HOLES
14 FAUCET, GASKET AND SUPPLY LINE ASSEMBLY

What is claimed is:

1. A method of installing a faucet on a sink, said method comprising:

a threaded leg comprising a first portion being threaded and connected to the body of said faucet;

a passage in said first portion fluidly being connected directly to a valve in said faucet;

said faucet being configured to pass liquid from a supply line to said valve in said faucet; and a second portion configured to be disposed between said supply line of said first portion;

said first threaded portion having a substantially larger outer diameter than the outer diameter of said second portion;

attaching a supply line to said second portion;

running said supply line down into and through a sink access hole in said sink;

disposing a securing nut onto said supply line after said supply line has been extended to an area under a sink deck;

said securing nut having a threaded diameter configured to pass over said second portion and thread onto said first threaded portion;

pushing said nut over said supply line and said second portion while positioning oneself outside a portion of said sink deck while threading said nut onto said first portion; and tightening said nut and securing said faucet to said sink deck.

2. A method of installing a hot and cold water faucet on a sink, by hand, without the installer having to be on his or her back under the sink, wherein said faucet comprises:

a faucet body comprising a spout and at least one water control handle;

said faucet body comprising two water supply arrangements extending from said faucet body;

each said water supply arrangement comprising a cylindrical body with at least two parts and with a water supply passage therein;

each said water supply passage being connected or connectable to a valve to supply water to said valve;

each said first portion being connected or connectable to said faucet body;

said first portion comprising a threaded portion configured to receive a securing nut;

each second portion configured to be disposed or being disposed between said supply line of said first portion;

each second portion configured to be connectable to a connecting element configured to connect said supply line to a supply line;

said first portion comprising a larger outer diameter than the outer diameter of said second portion;

the outer diameter of said second portion being sufficiently small to permit said securing nut to pass thereover;

each said securing nut comprising a thread configured to mate with the thread of its corresponding first portion;

said method comprising:

attaching a water supply line to each water supply arrangement;

running each said supply line down into and through its sink access hole in said sink;

disposing each said securing nut, by hand, onto each said supply line after each said supply line has been extended to an area under a sink deck;

each said securing nut having a threaded inside diameter configured to pass over each said second portion and a connector attached to each said second portion;

an installer pushing each said nut, by hand, over its corresponding supply line and its corresponding second portion while positioning him- or herself with his or her body outside a portion of said sink deck while without the installer having to be on his or her back under the sink and while manipulating each said nut onto its corresponding first portion;

threading, by hand, each said securing nut onto said first portion while positioning him- or herself with his or her body outside a portion of said sink deck and without the installer having to be on his or her back under the sink; and tightening each said securing nut, by hand, and securing said faucet to said sink deck while positioning him- or herself with his or her body outside a portion of said sink deck and without the installer having to be on his or her back under the sink.

3. The method of installing a hot and cold water faucet on a sink, by hand, without the installer having to be on his or her back under the sink according to claim 2 wherein said attachment nuts being configured to be handled by an installer and having appendages configured to increase the torque available to an installer's hand.

4. The method of installing a hot and cold water faucet on a sink, by hand, without the installer having to be on his or her back under the sink according to claim 3 wherein said appendages are radial and flat.

5. The method of installing a hot and cold water faucet on a sink, by hand, without the installer having to be on his or her back under the sink according to claim 3 wherein said water supply arrangements each comprise a single part.

6. The method of installing a hot and cold water faucet on a sink, by hand, without the installer having to be on his or her back under the sink according to claim 2 wherein said water supply arrangements each comprise a single part.

7. The method of installing a hot and cold water faucet on a sink, by hand, without the installer having to be on his or her back under the sink according to claim 3 wherein said water supply arrangements each are permanently connected to its corresponding valve.

8. The method of installing a hot and cold water faucet on a sink, by hand, without the installer having to be on his or her back under the sink according to claim 2 wherein said water supply arrangements each are permanently connected to its corresponding valve.

9. The method of installing a hot and cold water faucet on a sink, by hand, without the installer having to be on his or her back under the sink according to claim 4 wherein said water supply arrangements each are permanently connected to its corresponding valve.

10. The method of installing a hot and cold water faucet on a sink, by hand, without the installer having to be on his or her back under the sink according to claim 3 wherein said water supply arrangements each are disconnectable from its corresponding valve.

11. The method of installing a hot and cold water faucet on a sink, by hand, without the installer having to be on his or her back under the sink according to claim 2 wherein said water supply arrangements each are disconnectable from its corresponding valve.

12. The method of installing a hot and cold water faucet on a sink, by hand, without the installer having to be on his or her back under the sink according to claim 4 wherein said water supply arrangements each are disconnectable from its corresponding valve.

13. The method of installing a hot and cold water faucet on a sink, by hand, without the installer having to be on his or her back under the sink according to claim 5 wherein said water supply arrangements each are disconnectable from its corresponding valve.

14. The method of installing a hot and cold water faucet on a sink, by hand, without the installer having to be on his or her back under the sink according to claim 6 wherein said first portion and said second portion are disconnectable from one another.

15. The method of installing a hot and cold water faucet on a sink, by hand, without the installer having to be on his or her back under the sink according to claim 2 wherein said first portion and said second portion are disconnectable from one another.

16. The method of installing a hot and cold water faucet on a sink, by hand, without the installer having to be on his or her back under the sink according to claim 2 where each said second portion comprises:

a threaded portion configured to receive said connecting element which is threaded or a quick connect portion configured to receive said connecting element which is a quick connect connecting element.

17. The method of installing a hot and cold water faucet on a sink, by hand, without the installer having to be on his or her back under the sink according to claim 15 where each said second portion comprises:

a threaded portion configured to receive said connecting element which is threaded or a quick connect portion configured to receive said connecting element which is a quick connect connecting element.

18. A hot and cold water faucet arrangement configured to be installed on a sink, by hand, without the installer having to be on his or her back under the sink, wherein said faucet comprises:

a faucet body comprising a spout and at least one water control handle;

said faucet body comprising two water supply arrangements extending from said faucet body;

each said water supply arrangement comprising a cylindrical body with at least two parts and with a water supply passage therein;

each said water supply passage being connected or connectable to a valve to supply water to said valve;

each said first portion being connected or connectable to said faucet body;

said first portion comprising a threaded portion configured to receive a securing nut;

each second portion configured to be disposable or being disposed between said supply line of said first portion;

each second portion configured to be connectable to a connecting element configured to connect said supply line to a supply line;

said first portion comprising a larger outer diameter than the outer diameter of said second portion;

the outer diameter of each said second portion and each said connecting element being sufficiently small to permit said securing nut to pass thereover;

each said securing nut comprising a thread configured to mate with the thread of its corresponding first portion;

each water supply line being configured to be attachable to each water supply arrangement;

each said supply line being configured to be run down into and through its corresponding sink access hole in said sink;

each said securing nut being configured to be disposed, by hand, onto each said supply line after each said supply line has been extended to an area under a sink deck;

each said securing nut having a threaded inside diameter configured to pass over each said second portion and a connector attached to each said second portion;

each said nut being installable, by hand, over its corresponding supply line and its corresponding second portion with an installer positioning him- or herself with his or her body outside a portion of said sink deck while without the installer having to be on his or her back under the sink and while manipulating each said nut onto its corresponding first portion;

each said securing nut being threadable by hand onto said first portion upon an installer positioning him- or herself with his or her body outside a portion of said sink deck and without the installer having to be on his or her back under the sink; and each said securing nut being tightenable, by hand, to secure said faucet to said sink deck upon an installer positioning him- or herself with his or her body outside a portion of said sink deck and without the installer having to be on his or her back under the sink.

19. The hot and cold water faucet arrangement configured to be installable on a sink, by hand, without the installer having to be on his or her back under the sink according to claim 18 including at least one of the following:

(A) said attachment nuts being configured to be handled by an installer and having appendages configured to increase the torque available to an installer's hand;

(B) said water supply arrangements each comprise a single part;

(C) said water supply arrangements each are permanently connected to its corresponding valve;

(D) said water supply arrangements each are disconnectable from its corresponding valve;

(E) said first portion and said second portion are disconnectable from one another; and (F) said attachment nuts being configured to be handled by an installer and having appendages configured to increase the torque available to an installer's hand; and said appendages comprising radial appendages with flat radial surfaces.

* * * * *